US005732478A

United States Patent [19]

Chapman et al.

[11] Patent Number: 5,732,478

[45] Date of Patent: Mar. 31, 1998

[54] FORCED AIR VACUUM DRYING

[75] Inventors: Chester W. Chapman; Charles S. Leech, Jr., both of Glendale, Ariz.

[73] Assignee: Altos Engineering, Inc., Glendale, Ariz.

[21] Appl. No.: 644,288

[22] Filed: May 10, 1996

[51] Int. Cl.[6] ..... F26B 9/00

[52] U.S. Cl. ..... 34/629; 34/402

[58] Field of Search ..... 34/92, 402, 461, 34/412, 629

[56] References Cited

U.S. PATENT DOCUMENTS

| | | | |
|---|---|---|---|
| 3,849,831 | 11/1974 | Deverter et al. | 15/316.1 |
| 4,426,793 | 1/1984 | Kuboyama | 34/92 |
| 4,922,628 | 5/1990 | Hella | 34/641 |
| 5,038,494 | 8/1991 | Lundquist et al. | 34/94 |
| 5,120,500 | 6/1992 | Eggersdorfer et al. | 34/92 |
| 5,433,020 | 7/1995 | Leech, Jr. | 34/403 |
| 5,524,363 | 6/1996 | Seidl et al. | 34/629 |

OTHER PUBLICATIONS

"Applications of the Coanda Effect", Scientific American, Jun. 1966, pp. 84–92.

*Primary Examiner*—Henry A. Bennett
*Assistant Examiner*—Pamela A. O'Connor
*Attorney, Agent, or Firm*—Cahill, Sutton & Thomas, P.L.C.

[57] ABSTRACT

Residual moisture is removed from an article by placing the article in a chamber, supplying heated fresh air to the chamber via one or more air knives, and evacuating the chamber to remove the residual moisture. The air knives entrain ambient air from within the chamber by Coanda effect air flow, thereby circulating a mixture of fresh air and ambient air about the article. The supply of air to the chamber is interrupted while the chamber is being evacuated to reduce the air pressure within the chamber to on kPa to vaporize residual moisture in the article.

8 Claims, 1 Drawing Sheet

FORCED AIR VACUUM DRYING

BACKGROUND OF THE INVENTION

This invention relates to vacuum drying of articles and, in particular, to apparatus and method for rapidly reducing the residual moisture in delicate articles to less than a prescribed maximum moisture content.

In the manufacture of semiconductor devices, a semiconductor die is attached to a leadframe and is then encapsulated in plastic. Devices encapsulated in plastic are hydroscopic due to the plastic. Moisture is absorbed along the leads into the interior of the package and some moisture is infused from the plastic itself. The moisture within the package can lead to one of several failure mechanisms.

An industry accepted maximum moisture content is 0.04 percent (1/2500) of the total weight of the package. If the moisture content exceeds this level, a "popcorn" failure is likely to occur when a device is heated, e.g. when the leads are soldered to a printed circuit board. Soldering raises the temperature of the leads to about 172 °C. and the heat is conducted to the die from the leads, vaporizing the moisture in the package and increasing the internal pressure of the package. The internal pressure stresses the package, particularly at the corners, and the package pops or fractures. Visual inspection detects severly fractured devices, which are then removed from the printed circuit board and replaced. Replacing the device is expensive, time consuming, and can cause damage to the printed circuit board. Devices that are not severely damaged are not discovered visually and become a continuing reliability problem in the final product.

Internal moisture, particularly in the vapor state, can also damage the semiconductor die, e.g. by corroding the intermetallic bonds connecting the leads to the die. Even though semiconductors are processed in relatively dry environments using heat and vacuum for some of the process steps, the residual moisture content of a semiconductor device is typically less than one percent. The final step in making many integrated circuits is "dry packing," a slow and expensive de-moisturizing process.

For dry packing, the finished semiconductor devices are placed in trays in convection ovens and heated to 125°–150°C. for 16–24 hours. The devices are removed from the ovens, cooled, and packed in a vapor proof bag that is then evacuated and heat sealed. Dry packing adds considerably to the cost and to the time for producing semiconductor devices. Other packaging techniques use reels (pockets molded in a plastic tape wound on reels) or tubes that are typically open at both ends. Devices stored in reels may take as long as 190 hours to dry to an acceptable moisture content.

In view of the foregoing, it is therefore an object of the invention to provide apparatus and method for reducing residual moisture in delicate articles, such as semiconductor devices, to less than 0.04 percent by weight.

Another object of the invention is to provide apparatus and method for reducing residual moisture below 0.04 percent in less than five hours.

A further object of the invention is to provide apparatus and method for reducing residual moisture to zero in delicate articles.

SUMMARY OF THE INVENTION

The foregoing objects are achieved by this invention in which residual moisture is removed from an integrated circuit by placing the integrated circuit in a chamber, supplying heated fresh air to the chamber via one or more air knives, and evacuating the chamber to remove the residual moisture. The air knives entrain ambient air from within the chamber by Coanda effect air flow, thereby circulating a mixture of fresh air and ambient air about the integrated circuit. The supply of air to the chamber is interrupted while the chamber is being evacuated to reduce the air pressure within the chamber to a few kPa. to vaporize residual moisture in the integrated circuit.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
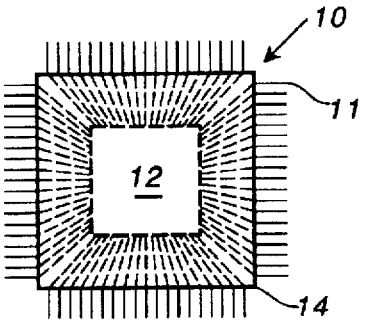
FIG. 1 illustrates a semiconductor package subject to popcorn failure.

FIG. 1 illustrates plastic encapsulated device 10 having a plurality of leads, such as lead 11, extending from four sides of the package and connected to die 12 within the package. If the residual moisture within the package exceeds 0.04 percent, the package is susceptible to mechanical failure particularly at corners, such as corner 14. In accordance with the invention, device 10 is quickly dried to a residual moisture content of less than 0.04 percent by warming the device and subjecting the device to an alternate cycles of heating and vacuum.

Figure 2:
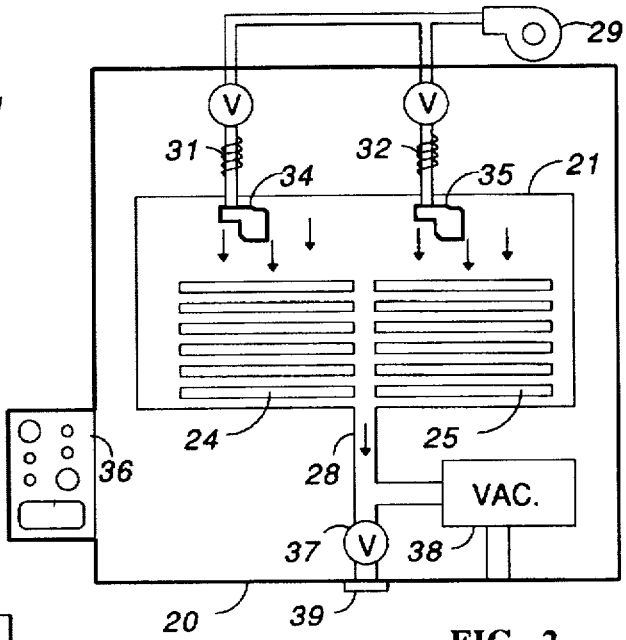
FIG. 2 is a diagram of forced air drying apparatus constructed in accordance with the invention.

FIG. 2 illustrates a forced air, vacuum drying system constructed in accordance with the invention. System 20 includes chamber 21 for receiving a plurality of standard (JEDEC) carrier trays, each tray containing a plurality of semiconductor devices. Reels can be used instead of trays. Heater 31 is pneumatically coupled to air knife 34 and heater 32 is pneumatically coupled to air knife 35. Heater 31 and heater 32 warm fresh air to approximately 125° C. and supply the heated air to chamber 21 through air knives 34 and 35, which distribute the heated air throughout the chamber. Other means, such as perforated pipes, could be used for distributing hot air throughout chamber 21 but hot air knives are preferred.

Figure 3:
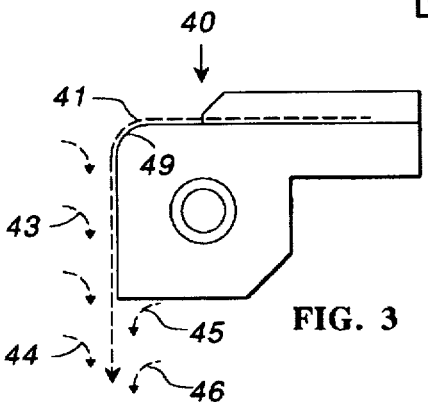
FIG. 3 is a diagram of an air knife used in the apparatus of FIG. 2.

FIG. 3 illustrates the operation of a hot air knife, which relies on the Coanda Effect, discovered in 1910 by Henri Coanda. Air stream 41 adheres to surface 49 of knife 40 and entrains a much larger volume of ambient air, indicated by arrows 43–46, as the stream leaves the surface of the air knife. Air knife 40 is viewed end-on in FIG. 3 and, in one embodiment of the invention, had a length of twenty-four inches. Air knives are commercially available in various sizes from Exair Corporation of Cincinnati, Ohio, for example.

Clean fresh air is supplied to the air knives at approximately 80 psig. and the air knives have a flow of about 1.9 SCFM per linear inch at that pressure. An air knive, twelve inches long, provides a flow of 171 SCFM, including the entrained chamber air. Supplying 22.8 SCFM of heated air may seem high but is only about forty-four percent of the flow required if perforated pipes had been used. In one embodiment of the invention, using a single knife, the chamber was eighteen inches high by twenty-six inches wide by thirty-three inches deep, for a total volume of 8.94 cubic feet and a capacity of two hundred standard trays.

Referring to FIG. 2, an air knife provides several advantages. A first is that a column of warm, dry air is directed to the tray beneath the knives. Another advantage is that the entrainment of ambient air assures good circulation within chamber 21, and, in particular, assures turbulent flow about the trays. The turbulent circulation within chamber 21 warms the devices uniformly among the trays and provides uniform drying. The entrainment of a large volume of air reduces the amount of fresh air which must be heated and supplied to chamber 21 during each heating cycle. An air knife can entrain as much as twenty times the volume of air flowing through the air knife.

When source 29 is supplying air to heaters 31 and 32, valve 37 is open, allowing chamber 21 to empty through output 28 to exhaust port 39. Vacuum pump 38 is also coupled to output 28 and evacuates the chamber. Output 28 is preferably on the opposite side of chamber 21 from air knives 34 and 35, i.e. the path from the air knives to the output intersects the devices to be dried. Source 29 represents an on-site supply of air or gas.

Figure 4:
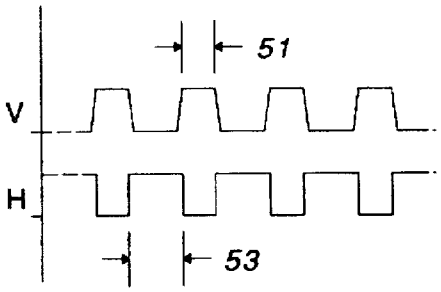
FIG. 4 is a diagram of the air supply and air pressure within the drying apparatus.

As illustrated in FIG. 4, the hot air knives work periodically to remove the residual moisture from the devices within chamber 21. Vacuum pump 38 (FIG. 2) operates when air knives 34 and 35 shut off, reducing the pressure within chamber to about one kPa. In one embodiment of the invention, semiconductor devices were subjected to warm air for approximately 30 minutes, as indicated at 53, and then subjected to vacuum for a period of 30 minutes as indicated at 51. The alternate cycles of heating and low pressure each promote vaporization of the residual moisture in the devices within chamber 21. Heated air warms the devices and prevents the residual moisture from freezing when the devices are subjected to low pressure. Control panel 36 (FIG. 2) includes suitable electronics for cycling heaters 31 and 32, monitoring temperature and pressure, and operating the valves for controlling the flow of air to and from chamber 21.

The maximum temperature of the heated air is determined by the device being dried. For example, plastic encapsulated semiconductor devices should not be subjected to air having a temperature more than about 160° C. to avoid damage to the devices. Other articles may have a higher or lower maximum temperature. Lower temperatures increase drying time because heat transfers more slowly as the temperature difference between two masses decreases. 40° C. is a useful minimum temperature.

The minimum pressure depends to some extent upon the mass and the specific heat of the devices. Vaporizing the residual moisture cools the device but the mass of available water is such a small percentage of the mass of the device that freezing is unlikely, particularly if the devices are heated initially. A minimum pressure of one kPa. has been used for integrated circuits and can be used for most devices. A minimum pressure less than one kPa. increases the load on the vacuum pump without a significant decrease in drying time.

Figure 5:
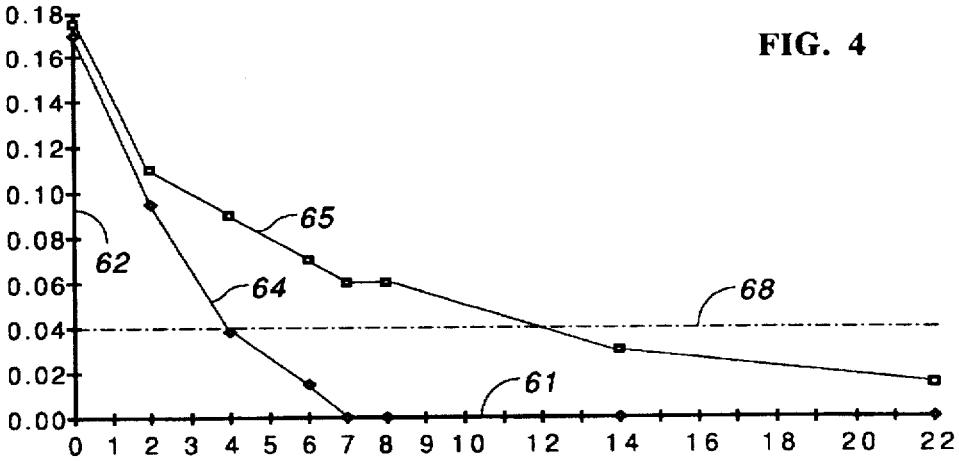
FIG. 5 is a graph comparing the drying apparatus illustrated in FIG. 2 with a convection oven.

FIG. 5 illustrates a comparison between apparatus constructed in accordance with the invention and a convection oven of the prior art. In FIG. 4, abscissa 61 represents time in hours and ordinate 62 represents percent moisture. Data for the graph was obtained by subjecting a plurality of MQFP packages 28 mm.×28 mm. to eighty-five percent relative humidity at 85° C. for one hundred sixty-eight hours. The convection oven and the drying apparatus constructed in accordance with the invention were both set to a maximum temperature of 125° C.

Curve 64 represents the average of data taken from devices dried in accordance with the invention. Curve 65 represents the average of data taken from devices dried in a convection oven. Line 68 represents the industry accepted maximum moisture content. As can be seen from FIG. 5, devices dried in accordance with the invention had a moisture content less than the industry maximum after slightly less than four hours, whereas it took a convection oven slightly more than twelve hours to achieve the same level of moisture content. Unlike the prior art, a moisture content of zero percent is obtainable from apparatus constructed in accordance with the invention. In a convection oven, the moisture content approaches zero asymptotically.

The invention thus provides an apparatus and method for reducing residual moisture content in delicate articles to less than 0.04 percent by weight in less than five hours. In addition, the residual moisture content can be reduced to zero, if desired, within seven hours. In contrast, the present JEDEC specification for demoisturizing military products requires a moisture content of less than 0.04 percent. This is typically attained by heating the devices to 125° C. for up to twenty-four hours. The present IPC SM-786 specification for demoisturizing commercial products requires a moisture content of less than 0.08 percent. This is typically attained by heating the reeled devices to 40° C. for up to one hundred and ninety-two hours. The invented apparatus can reduce the moisture content of reeled devices to 0.04 percent within ten hours.

Having thus described the invention, it will be apparent to those of skill in the art that various modifications can be made within the scope of the invention. For example, heaters 31 and 32 are not necessarily turned on for as long as fresh air is being supplied to the air knives. The heaters can be operated intermittently to maintain a predetermined average temperature within chamber 21 or a predetermined average temperature within the fresh air supplied to chamber 21. FIG. 2 illustrates a chamber with a single outlet. More than one outlet can be used. Although described using air as the medium for conveying heat, a gas or a gas mixture can be used instead, e.g. argon, nitrogen.

What is claimed as the invention is:

1. A process for removing residual moisture from an article, said process comprising the steps of:

placing said article in a chamber;

supplying warm air to said chamber during a first period of time and circulating said warm air about said article to heat said article; and interrupting the supply of warm air to said chamber after the first period of time and thereafter evacuating said chamber to remove said residual moisture.

2. The process as set forth in claim 1 wherein said supplying step includes:

heating a quantity of fresh air; and directing said quantity of fresh air at said article by means of an air knife to entrain ambient air from within the chamber, thereby circulating a mixture of fresh air and ambient air about said article.

3. The process as set forth in claim 2 wherein said fresh air is heated to a temperature less than 160° C.

4. The process as set forth in claim 2 wherein said fresh air is heated to a temperature of 125° C.

5. Apparatus for removing residual moisture from an article, said apparatus comprising:

an evacuable chamber for containing said article;

a fresh air inlet communicating with said chamber for selectively introducing fresh air into said chamber;

a heater pneumatically coupled to said fresh air inlet for selectively warming fresh air introduced into said chamber;

an exhaust port communicating with said chamber for selectively allowing air with said chamber to escape therefrom;

vacuum means coupled to said chamber for selectively reducing the pressure within said chamber; and control means for selectively opening said fresh air inlet, deactivating said vacuum means, and opening said exhaust port for allowing warmed fresh air to circulate about said article for initially heating said article, said control means alternatively closing said fresh air inlet, closing said exhaust port, and activating said vacuum means and subjecting said article to reduce pressure.

6. The apparatus as set forth in claim 5 wherein said fresh air inlet includes an air knife for distributing air within said chamber.

7. The apparatus as set forth in claim 6 wherein said fresh air inlet includes a plurality of air knives for distributing air within said chamber.

8. A process for removing residual moisture from an article, said process comprising the steps of:

a) placing said article in a chamber;

b) directing a supply of warmed, fresh air at said article for a first period of time;

c) interrupting the supply of warmed, fresh air after the first period of time has elapsed;

d) reducing the pressure in said chamber for a second period of time;

e) terminating the pressure-reducing step d) above after the second period of time has elapsed; and f) repeating steps b), c) and d).

* * * * *